US012808565B2

(12) United States Patent
Cluff et al.

(10) Patent No.: US 12,808,565 B2
(45) Date of Patent: Nov. 24, 2026

(54) SYSTEM AND METHOD FOR CONTROLLING OPERATION OF A HEAT PUMP CONFIGURED WITH AN ELECTRIC HEATER

(71) Applicants: Charles Cluff, Zionsville, IN (US); Adam Finney, Carmel, IN (US)

(72) Inventors: Charles Cluff, Zionsville, IN (US); Adam Finney, Carmel, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 146 days.

(21) Appl. No.: 18/818,870

(22) Filed: Aug. 29, 2024

(65) Prior Publication Data

US 2025/0075931 A1 Mar. 6, 2025

Related U.S. Application Data

(60) Provisional application No. 63/580,433, filed on Sep. 4, 2023.

(51) Int. Cl.
*F24F 11/65* (2018.01)
*F24F 120/10* (2018.01)

(52) U.S. Cl.
CPC ..... *F24F 11/65* (2018.01); *F24F 2120/10* (2018.01)

(58) Field of Classification Search
CPC .. F24F 11/65; F24F 11/46; F24F 11/77; F24F 11/86; F24F 11/64; F24F 2110/10; F24F 2120/14; F24F 2130/10; F24F 2200/08; F24F 2221/34; F24F 5/12; F24F 3/001; F24F 1/0093
See application file for complete search history.

(56) References Cited

U.S. PATENT DOCUMENTS 4,702,305 A 10/1987 Beckey et al.
5,245,835 A 9/1993 Cohen et al.
7,628,337 B2 12/2009 Cuppetilli et al.
8,141,791 B2 3/2012 Rosen
(Continued)

FOREIGN PATENT DOCUMENTS

JP 6341021 B2 6/2018

OTHER PUBLICATIONS

Extended European Search Report received for EP Application No. 24197977.2, mailed on Apr. 2, 2025, 11 Pages.

*Primary Examiner* — Marc E Norman
(74) *Attorney, Agent, or Firm* — Andrew Goldberg

(57) ABSTRACT

A system for controlling operation of a heat pump configured with an electric heater. The system comprises an occupancy sensor positioned in an area of interest (AOI) and is operable to detect presence/absence of occupants within the AOI. The system supplies air within the AOI while flowing the air through the heat pump and the electric heater. The system comprises a controller that is configured to receive data pertaining to a first predefined temperature for the air to be supplied to the AOI, monitor real-time temperature of the air being supplied to the AOI, detect, using the occupancy sensor, presence of the occupants within the AOI, and operate, upon detecting the presence of the one or more occupants within the AOI, the heat pump and/or the electric heater to adjust the temperature of the air being supplied to the AOI to the first predefined temperature.

18 Claims, 5 Drawing Sheets

(56) References Cited

U.S. PATENT DOCUMENTS

| | | | | |
|---|---|---|---|---|
| 8,374,725 | B1 | 2/2013 | Ols | |
| 8,560,127 | B2 | 10/2013 | Leen et al. | |
| 8,839,632 | B2 | 9/2014 | Goenka et al. | |
| 9,103,573 | B2 | 8/2015 | Goenka et al. | |
| 9,682,608 | B2 | 6/2017 | Goenka et al. | |
| 9,851,114 | B2 | 12/2017 | Zinger et al. | |
| 10,571,135 | B2 | 2/2020 | Kreutzman | |
| 11,067,305 | B2 | 7/2021 | Brahme et al. | |
| 11,268,730 | B2 | 3/2022 | Helbling | |
| 11,397,014 | B2 | 7/2022 | Bhosale et al. | |
| 11,454,407 | B1 | 9/2022 | Akin et al. | |
| 11,543,146 | B2 | 1/2023 | Hartman | |
| 2010/0242507 | A1 | 9/2010 | Meckler | |
| 2010/0243231 | A1* | 9/2010 | Rosen | F24F 11/63 236/46 C |
| 2016/0363943 | A1 | 12/2016 | Stefanski et al. | |
| 2021/0372648 | A1* | 12/2021 | Olson | F25B 30/02 |
| 2023/0138109 | A1* | 5/2023 | Shaffer | F24F 11/77 62/56 |

* cited by examiner

SYSTEM AND METHOD FOR CONTROLLING OPERATION OF A HEAT PUMP CONFIGURED WITH AN ELECTRIC HEATER

CROSS-REFERENCE TO RELATED APPLICATION

This patent application claims the benefit of U.S. Provisional Patent Application No. 63/580,433, filed on Sep. 4, 2023, which is incorporated by reference herein in its entirety.

BACKGROUND

This invention relates to the field of heat pumps, and more particularly, to a system and method for controlling the operation of a heat pump being configured with an electric heater, which may be installed in an area of interest (AOI) or environment to supply comfortable warm air within the AOI or environment as per occupant's comfort.

SUMMARY

Described herein is a system for controlling operation of a heat pump configured with an electric heater. The system comprises an occupancy sensor positioned in an area of interest (AOI) and operable to detect presence or absence of one or more occupants within the AOI, wherein the system is configured to supply air to the AOI while enabling flow of the air through the heat pump and the electric heater. The system further comprises a controller in communication with the occupancy sensor, the heat pump, and the electric heater, wherein the controller comprises one or more processors coupled to a memory storing instructions executable by the one or more processors, and configured to: receive data pertaining to a first predefined temperature for the air to be supplied to the AOI; monitor real-time temperature of the air being supplied to the AOI; detect, using the occupancy sensor, presence of the one or more occupants within the AOI; and operate, upon detecting the presence of the one or more occupants within the AOI, the heat pump and/or the electric heater to adjust the temperature of the air being supplied to the AOI to the first predefined temperature.

In one or more embodiments, the controller is configured to stop or reduce the operation of the electric heater to adjust the temperature of the air being supplied to the AOI to the first predefined temperature upon detecting the absence of the one or more occupants within the AOI or upon operating the electric heater and the heat pump in a setback mode by the one or more occupants.

In one or more embodiments, when the monitored real-time temperature of the air being supplied to the AOI is detected to be less than the first predefined temperature and upon detecting the presence of the one or more occupants within the AOI, the controller is configured to operate both of the heat pump, and the electric heater to adjust the temperature of the air being supplied to the AOI to the first predefined temperature.

In one or more embodiments, when the monitored real-time temperature of the air being supplied to the AOI is detected to be less than the first predefined temperature and upon detecting the absence of the one or more occupants within the AOI, the controller is configured to stop the operation of the electric heater and operate the heat pump to increase the temperature of the air within the AOI.

In one or more embodiments, when the monitored real-time temperature of the air being supplied to the AOI is detected to be greater than the first predefined temperature, the controller is configured to reduce or stop the operation of the electric heater while allowing the supply of air into the AOI.

In one or more embodiments, the system comprises a variable speed fan configured with the electric heater or the heat pump, wherein the fan is in communication with the controller and is configured to adjust speed of the fan, based on a temperature of the air being supplied to the AOI.

In one or more embodiments, the system comprises a thermostat positioned within the AOI, wherein the thermostat is configured to enable the one or more occupants to set one or more of the first predefined temperature of the air to be supplied into the AOI, and a second temperature to be maintained within the AOI.

In one or more embodiments, the controller is configured to adjust heating capacity of the heat pump and/or the electric heater based on the real-time temperature of the air being supplied to the AOI and the first predefined temperature for the air to be supplied to the AOI.

In one or more embodiments, the electric heater is configured downstream of the heating coil of the heat pump.

In one or more embodiments, when the monitored real-time temperature within the AOI is detected to be greater than the second predefined temperature, the controller is configured to stop the operation of the heat pump and the electric heater.

In one or more embodiments, the system comprises a temperature sensor positioned in the AOI or at an air outlet of a duct system within which the heat pump and the electric heater are installed, wherein the temperature sensor is configured to monitor the real-time temperature of the air being supplied to the AOI, through the duct system.

Also described herein is a system for controlling operation of an HVAC device configured with an electric heater. The system comprises an occupancy sensor positioned in an area of interest (AOI) and operable to detect presence or absence of one or more occupants within the AOI, wherein the system is configured to supply air to the AOI while flowing the air through the HVAC device and the electric heater. The system further comprises a controller in communication with the occupancy sensor, the HVAC unit, and the electric heater, wherein the controller comprises one or more processors coupled to a memory storing instructions executable by the one or more processors, and configured to: receive data pertaining to a first predefined temperature for the air to be supplied to the AOI; monitor real-time temperature of the air being supplied to the AOI; detect, using the occupancy sensor, presence of the one or more occupants within the AOI; operate, upon detecting the presence of the one or more occupants within the AOI, the HVAC device and/or the electric heater to adjust the temperature of the air being supplied to the AOI to the first predefined temperature; and stop the operation of the electric heater upon detecting the absence of the one or more occupants within the AOI.

In one or more embodiments, when the monitored real-time temperature of the air being supplied to the AOI is detected to be less than the first predefined temperature and upon detecting the presence of the one or more occupants within the AOI, the controller is configured to operate the HVAC device in a heating mode and/or further operate the electric heater at a predefined heating capacity to increase the temperature of the air being supplied to the AOI to the first predefined temperature.

In one or more embodiments, when the monitored real-time temperature of the air being supplied to the AOI is detected to be greater than the first predefined temperature and upon detecting the presence of the one or more occupants within the AOI, the controller is configured to stop or reduce the operation of the electric heater and further operate the HVAC device in a cooling mode to decrease the temperature of the air being supplied to the AOI to the first predefined temperature.

Further described herein is a method for controlling operation of a heat pump configured with an electric heater. The method comprises the steps of; detecting, by an occupancy sensor, presence or absence of one or more occupants within an area of interest (AOI); receiving, by a controller, data pertaining to a first predefined temperature for air to be supplied to the AOI while flowing the air through the heat pump and the electric heater; monitoring, by the controller, real-time temperature of the air being supplied to the AOI; operating, by the controller, upon detecting the presence of the one or more occupants within the AOI, the heat pump and/or the electric heater to adjust the temperature of the air being supplied to the AOI to the first predefined temperature; and stopping, by the controller, the operation of the electric heater upon detecting the absence of the one or more occupants within the AOI.

In one or more embodiments, when the monitored real-time temperature of the air being supplied to the AOI is detected to be less than the first predefined temperature and upon detecting the presence of the one or more occupants within the AOI, the method comprises the steps of operating the heat pump, and the electric heater to adjust the temperature of the air being supplied to the AOI to the first predefined temperature.

In one or more embodiments, when the monitored real-time temperature of the air being supplied to the AOI is detected to be less than the first predefined temperature and upon detecting the absence of the one or more occupants within the AOI, the method comprises the steps of stopping the operation of the electric heater and operating the heat pump to increase the temperature of the air being supplied to the AOI.

In one or more embodiments, when the monitored real-time temperature of the air being supplied to the AOI is detected to be greater than the first predefined temperature, the method comprises the steps of stopping or reducing the operation of the heat pump and the electric heater.

In one or more embodiments, the method comprises the steps of adjusting, based on a temperature to be maintained within the AOI, speed of a fan configured upstream or downstream of the heat pump or the electric heater to control flow rate of the air being supplied to the AOI.

In one or more embodiments, the method comprises the steps of adjusting heating capacity of the heat pump and/or the electric heater based on the real-time temperature of the air being supplied to the AOI and the first predefined temperature for the air to be supplied to the AOI.

The foregoing summary is illustrative only and is not intended to be in any way limiting. In addition to the illustrative aspects, embodiments, and features described above, further aspects, embodiments, features, and techniques of the subject disclosure will become more apparent from the following description taken in conjunction with the drawings.

BRIEF DESCRIPTION OF THE DRAWINGS

The accompanying drawings are included to provide a further understanding of the subject disclosure and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
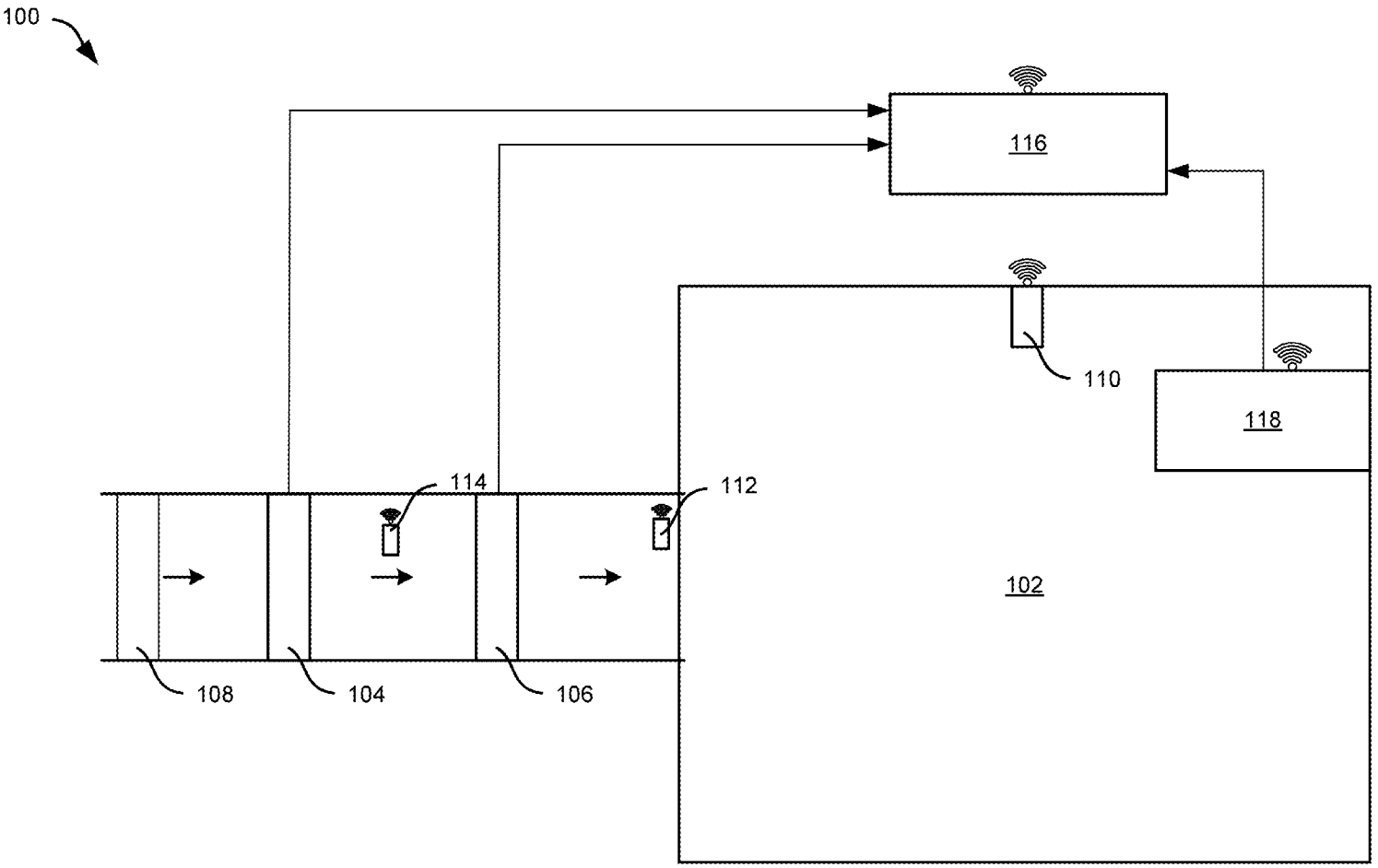
FIG. 1A illustrates an exemplary representation of a system comprising a heat pump configured with an electric heater, which is installed at an area of interest (AOI) or environment to supply comfortable warm air within the AOI or environment as per occupant's comfort, in accordance with one or more embodiments of the subject disclosure.

The following is a detailed description of embodiments of the subject disclosure depicted in the accompanying drawings. The embodiments are in such detail as to clearly communicate the subject disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. Described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, described herein may be oriented in any desired direction.

A heat pump may be installed at an environment or area of interest (AOI) to provide warm or conditioned air within the environment based on occupants' comfort. However, the heat pump operating in heating mode may not be capable of supplying air temperature as per occupants' comfort. The occupants may find the temperature of the air leaving the heat pump to be cooler than their comfortable range. To overcome this, the temperature of the air leaving the heat pump (for the environment) may be increased to a comfortable level by using a supplemental electric heater. The heating capacity of the electric heater may be varied to different levels as per the air temperature values being set by the occupants based on their comfort and the actual temperature of the air leaving the heat pump. Accordingly, the electric heater may increase the temperature of the air leaving the heat pump to a first predefined air temperature being set by the occupants. While the electric heater decreases the overall efficiency of the system, the additional comfort may be worth a moderate increase in heating cost. However, when occupants are not present in the environment, still the electric heater may keep operating. As a result, the benefits of operating the electric heater to supply warmer air are lost, but the additional cost or operating cost of the electric heater remains. This may increase the operating cost of the electric heater and further make the overall system inefficient and expensive.

This invention provides a simple, automated, efficient, and cost-effective system and method for controlling the operation of a heat pump being configured with an electric heater, which may be installed in the AOI or environment to supply comfortable warm air within the AOI or environment based on occupant's comfort. The invention may involve an occupancy sensor to detect the presence or absence of occupants within the environment. The invention accordingly enables automated and selective operation of the electric heater for the purpose of increasing occupant comfort based on the presence or absence of the occupants within the environment, thereby optimizing the use of the electric heater and making the overall invention efficient and cost-effective while supplying comfortable air to the occupants.

Figure 1B:
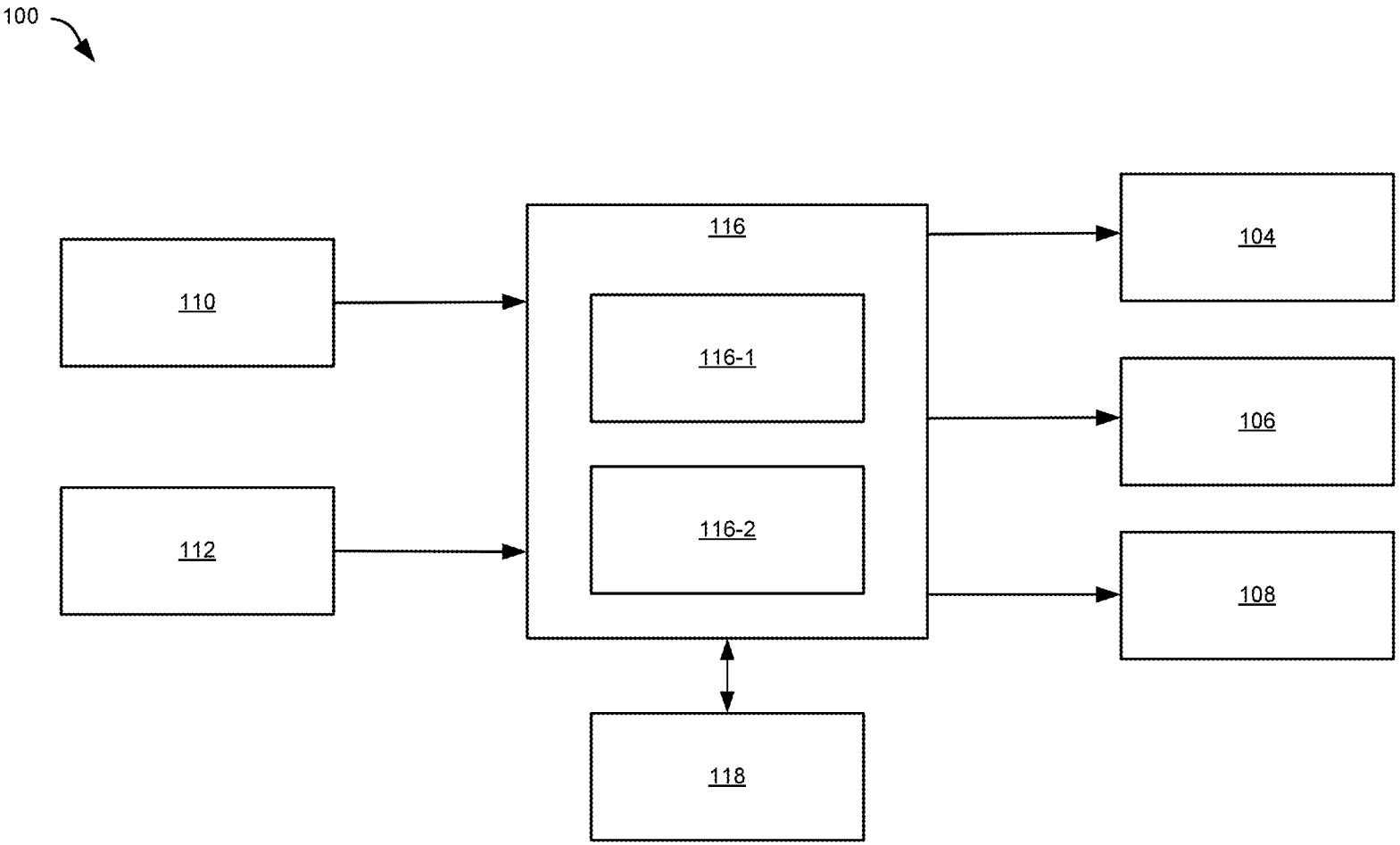
FIG. 1B illustrates an exemplary block diagram of the system of FIG. 1A, in accordance with one or more embodiments of the subject disclosure.

Referring to FIGS. 1A and 1B, the system 100 may include a heat pump 104 that may be in fluidic communication with an area of interest (AOI) 102 (also referred to as environment 102, herein). The AOI 102 may be a space or room associated with a building. The AOI 102 may also be a storage space associated with a container or a cargo truck but is not limited to the like. The system 100 may further include an electric heater 106 in fluidic communication with the heat pump 102 such that air flowing into the AOI 102 may flow through the heat pump 104 as well as the electric heater 106 and then into the AOI 102. In one or more embodiments, the heat pump 104 may be configured in a duct system that may fluidically connect the heat pump 104 to the AOI 102. The duct system may include a supply air duct extending between the ambient and the AOI 102 to allow the flow of ambient air from the ambient into the AOI 102 while flowing the received air through the heat pump 104 and the electric heater 106. The duct system may further include a return air duct (not shown) that may be configured to receive return air from the AOI 102 and further supply the received return air into the AOI 102 while flowing the received return air through the heat pump 104 and the electric heater 106. Accordingly, the duct system may enable the flow of supply air (ambient air and/or return air) through the heat pump 104 and the electric heater 106 and then into the AOI 102

In one or more embodiments, as shown in FIG. 1A, the electric heater 106 may be configured upstream or downstream of the heat pump 104. This configuration may enable heating of the supply air by one or more of the heat pump 104 and the electric heater 106 before being supplied to the AOI 102. In some embodiments (not shown), the electric heater 106 may be in thermal contact with the refrigerant coils associated with the heat pump 104 to increase the temperature of the air being supplied through the refrigerant coils of the heat pump 104, thereby increasing the heating capacity of the heat pump 104.

In one or more embodiments, the system may include a variable speed fan 108 configured with the duct system to enable circulation of the air between the ambient and the AOI 102 and further enable the flow of the air through the heat pump 104 and the electric heater 106 before being supplied to the AOI 102. However, in one or more embodiments, the system may also include a single speed fan 108, instead of a variable speed fan, to enable circulation of the air between the ambient and the AOI 102 and further enable the flow of the air through the heat pump 104 and the electric heater 106 before being supplied to the AOI 102. In one or more embodiments, the fan 108 may be positioned before (upstream of) both the heat pump 104 and the electric heater 106, or between the heat pump coil 104 and the electric heater 106 or after (downstream of) both the heat pump coil 104 and the electric heater 106.

In some embodiments, the system 100 may include an air handling unit associated with the AOI 102, which may include the fan 108, the heat pump 104, and the electric heater 106. The fan of the AHU may enable circulation of the air between the ambient and the AOI 102 and also enable the flow of the air through the heat pump 104 and the electric heater 106. In one or more embodiments, the electric heater 106 may include multiple heating elements. The heating capacity of the electric heater 106 may be adjusted (increased or decreased) by actuating one or more of the heating elements.

The system 100 may include an occupancy sensor 110 positioned in the AOI 102. The occupancy sensor 110 may detect the presence or absence of one or more occupants within the AOI 102. The system 100 may further include a first temperature sensor 114 that may be positioned downstream of the heat pump 104 to monitor the temperature of the air leaving the heat pump 104. Further, the system may include a second temperature sensor 112 that may be positioned downstream of the electric heater 106 within the duct system or at an outlet of the duct system, or within the AOI 102 in the proximity of the electric heater 106 to monitor the temperature of the air flowing within the AOI 102 after being heated by the heat pump 104 and/or the electric heater 106. In one or more embodiments, the first temperature sensor 114 and the second temperature sensor 112 may be replaced with a single temperature sensor that may be positioned after both the heat pump 104 and the electric heater 106 (regardless of the order of heat pump 104 and the electric heater 106 in the airflow) to monitor the temperature of the air being supplied to the AOI. In an example, when the heat pump 104 and the electric heater 106 are operating, the temperature of the air (sensed by the first temperature sensor 114) downstream of (or leaving) the heat pump 104 may be greater than the temperature of the air upstream of the heat pump 104. Further, the temperature of the air (sensed by the second temperature sensor 112) downstream of the electric heater 106 may be greater than the temperature of the air upstream of the electric heater (or downstream of the heat pump 104).

The system may further include a thermostat 118 positioned within the AOI 102. The thermostat 118 may be configured to enable the occupants to set one or more of a first predefined temperature of the air to be supplied into the AOI 102 based on the occupant's comfort and further set a second predefined temperature to be maintained within the AOI 102. The first predefined temperature of the air may facilitate adjusting or controlling or maintaining the second predefined temperature within the AOI 102, however, the first predefined temperature of the air may provide comfort to the occupants. In one or more embodiments, the second temperature sensor 112 may be associated with the thermostat 118, however, the second temperature sensor 112 may also be a standalone sensor as shown in FIG. 1A.

The system may further include a controller 116 in communication with the heat pump 104, the electric heater 106, the fan/AHU 108, the occupancy sensor 110, the thermostat 118, the first temperature sensor 114, and the second temperature sensor 112. Referring to FIG. 1B, the controller 116 may comprise one or more processors 116-1 coupled to a memory 116-2 storing instructions executable by the one or more processors 116-1, which may enable the controller 116 to perform one or more designated operations.

In one or more embodiments, the controller 116 may be configured to receive, from the thermostat 118, data pertaining to the first predefined temperature for the air to be supplied to the AOI 102. However, in other embodiments, the controller 116 may be configured to receive, from a control unit associated with the air handling unit, data pertaining to the first temperature for the air to be supplied to the AOI 102. The controller 116 may further monitor the real-time temperature of the air being supplied to the AOI 102 using the second temperature sensor 112. Further, the controller 116 may detect, using the occupancy sensor 110, the presence or absence of the occupants within the AOI 102. Accordingly, in one or more embodiments, upon detecting the presence of the occupants within the AOI 102, the controller 116 may operate the heat pump 104 and/or the electric heater 106 to adjust the temperature of the air being supplied to the AOI 102 to the first predefined temperature.

Figure 3:
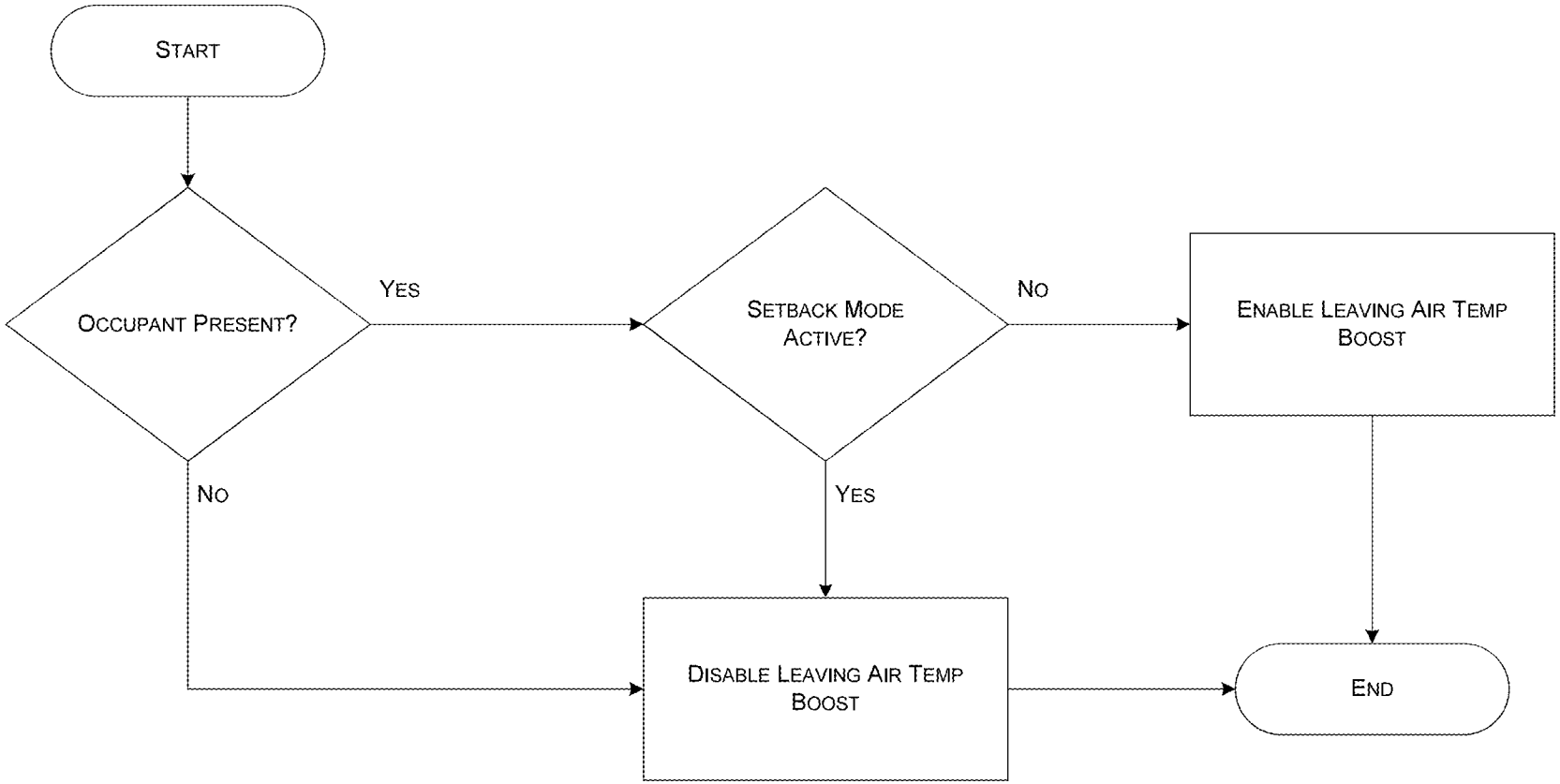
FIG. 3 illustrates an exemplary flow diagram depicting a control strategy implemented in the system of FIG. 1A, in accordance with one or more embodiments of the subject disclosure.

Further, in one or more embodiments, the controller 116 may be configured to stop the operation of the electric heater 106 upon detecting the absence of the occupants within the AOI 102. Referring to FIG. 3, in one or more embodiments, the controller 116 may allow the occupants to operate the electric heater 106 and the heat pump 104 in a setback mode where the controller 116 stops the operation of the electric heater 106 irrespective of the presence or absence of the occupants within the AOI 102. However, when the setback mode is not activated and the occupants are detected within the AOI 102, the controller 116 may operate both the heat pump 104, and the electric heater 106 to boost the air leaving temperature, thereby adjusting the temperature of the air being supplied to the AOI 102 to the first predefined temperature.

In one or more embodiments, when the real-time temperature of the air (monitored by the second temperature sensor 112) being supplied to the AOI 102 is detected to be less than the first predefined temperature set by the occupants and the occupants are also detected within the AOI 102, the controller 116 may be configured to operate both of the heat pump 104 and the electric heater 106 to adjust the temperature of the air being supplied to the AOI 102 to the first predefined temperature.

In one or more embodiments, when the real-time temperature of the air (monitored by the second temperature sensor 112) being supplied to the AOI 102 is detected to be less than the first predefined temperature set by the occupants but the occupants are detected to be absent from the AOI 102, the controller 116 may be configured to stop the operation of the electric heater 106 while continuing to operate the heat pump 104 to increase the temperature of the air being supplied to the AOI 102.

In one or more embodiments, when the monitored real-time temperature of the air being supplied to the AOI 102 is detected to be greater than the first predefined temperature set by the occupants, the controller 116 may be configured to reduce or stop the operation of the electric heater 106 while operating the heat pump 104 and allowing the supply of air into the AOI 102 to increase or maintain a second predefined temperature within the AOI 102 . . . . In one or more embodiments, when the monitored real-time temperature within the AOI 102 is detected to be greater than a second predefined temperature set by the occupants, the controller 116 may be configured to stop the operation of the heat pump 104 as well as the electric heater 106.

In some embodiments, the controller 116 may also be configured to adjust speed of the fan 108, based on the temperature of the air to be supplied to the AOI 102. This may facilitate in increasing or decreasing the temperature of the air supplied to the AOI 102. Further, in one or more embodiments, the controller 116 may be configured to adjust the heating capacity of the heat pump 104 and/or the electric heater 106 (by actuating the heating elements) based on the real-time temperature of the air being supplied to the AOI 102 and the first predefined temperature for the air to be supplied to the AOI 102 and/or based on the real-time temperature within the AOI 102 and the second predefined temperature to be maintained within the AOI 102.

The controller 116, the heat pump 104, the electric heater 106, the fan/AHU 108, the occupancy sensor 110, the thermostat 118, the first temperature sensor 114, and the second temperature sensor 112 may include a transceiver or a communication module to communicatively connect the controller 116 to one or more of the heat pump 104, the electric heater 106, the fan/AHU 108, the occupancy sensor 110, the thermostat 118, the first temperature sensor 114, and the second temperature sensor 112, through a network via wired and/or wireless media. In one or more embodiments, the system or controller 116, and mobile devices associated with the occupants of the AOI 102 or registered users or the admin may be operatively coupled to a website and so be operable from any Internet-enabled user device. The mobile devices may allow the occupants, the users, and the admin to monitor and control the operation of the system. Examples of mobile devices may include but are not limited to, a portable computer, a personal digital assistant, a handheld device, and a workstation.

In one or more embodiments, the network can be a wireless network, a wired network or a combination thereof. Network can be implemented as one of the different types of networks, such as intranet, local area network (LAN), wide area network (WAN), the internet, and the like. Further, the network may either be a dedicated network or a shared network. The shared network represents an association of the different types of networks that use a variety of protocols, for example, Hypertext Transfer Protocol (HTTP), Transmission Control Protocol/Internet Protocol (TCP/IP), Wireless Application Protocol (WAP), and the like, to communicate with one another. Further, network can include a variety of network devices, including transceivers, routers, bridges, servers, computing devices, storage devices, and the like. In another implementation the network can be a cellular network or mobile communication network based on various technologies, including but not limited to, Global System 100 for Mobile (GSM), General Packet Radio Service (GPRS), Code Division Multiple Access (CDMA), Long Term Evolution (LTE), WiMAX, 5G or 6G network protocols, and the like.

Figure 2:
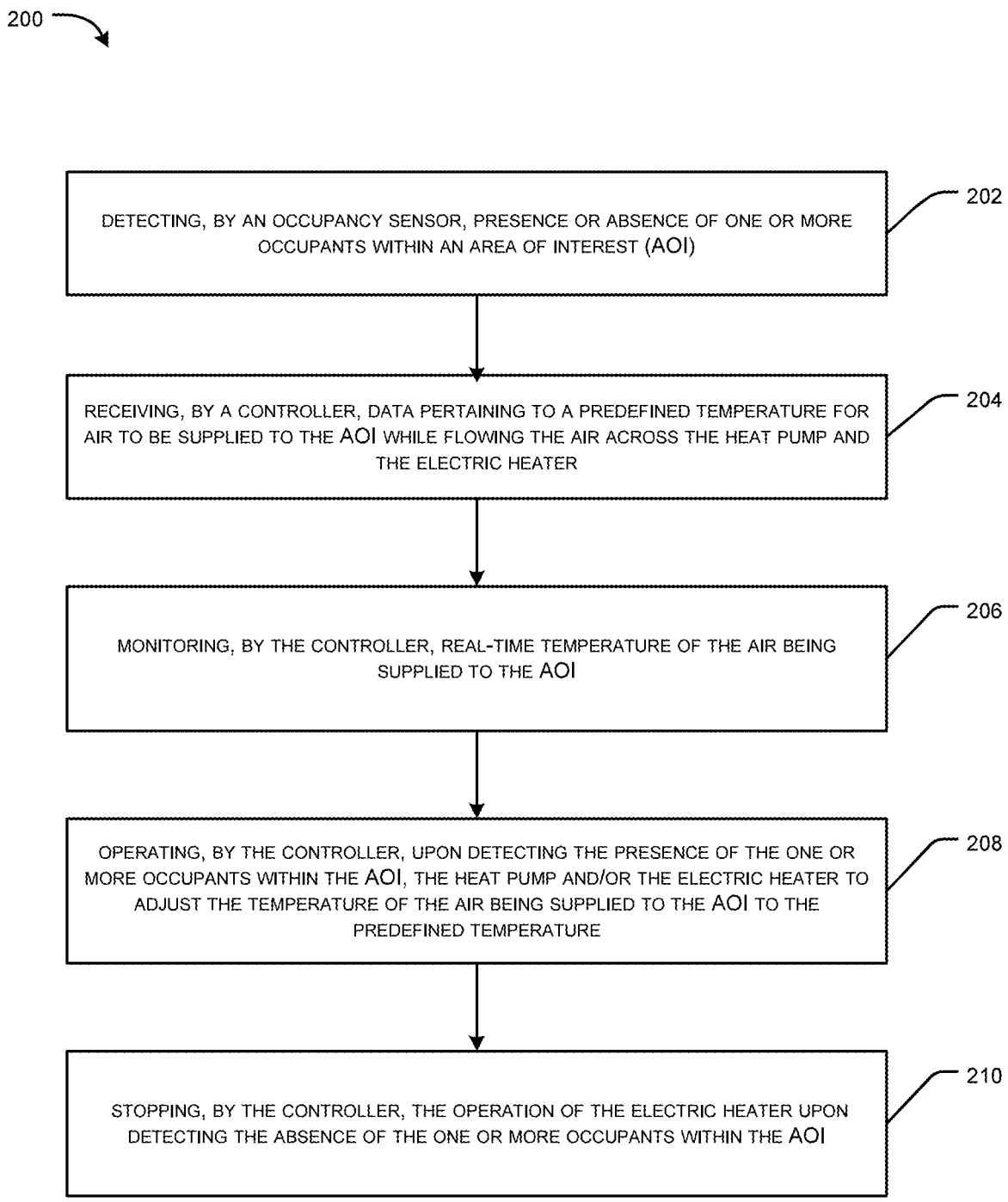
FIG. 2 illustrates an exemplary flow diagram of a method for controlling the operation of a heat pump being configured with an electric heater to supply comfortable warm air within the AOI or environment as per occupant's comfort, in accordance with one or more embodiments of the subject disclosure.

Referring to FIG. 2, method 200 for controlling the operation of an electric heater and the heat pump associated with an area of interest (AOI) is disclosed, which may control the temperature of the air leaving the electric heater and the heat pump as per occupants' comfort before being supplied to the AOI. Method 200 may involve the controller 116, the heat pump 104, the electric heater 106, the fan/AHU 108, the occupancy sensor 110, the thermostat 118, the first temperature sensor 114, the second temperature sensor 112, and other components associated with the system 100 of FIGS. 1A and 1B. Method 200 may include step 202 of detecting, by the occupancy sensor, presence or absence of one or more occupants within the AOI. Further, method 200 may include step 204 of receiving, by the controller, data pertaining to a first predefined temperature for air to be supplied to the AOI while flowing the air through the heat pump and the electric heater. and another step 206 of monitoring, by the controller, the real-time temperature of the air being supplied to the AOI.

In one or more embodiments, upon detecting the presence of the occupants within the AOI, method 200 may include step 208 of operating, by the controller, the heat pump and/or the electric heater to adjust the temperature of the air being supplied to the AOI to the first predefined temperature. Further, in one or more embodiments, upon detecting the absence of the occupants within the AOI, method 200 may include step 210 of stopping by the controller, the operation of the heat pump and/or the electric heater to adjust the temperature of the air being supplied to the AOI to the first predefined temperature.

In one or more embodiments, when the monitored real-time temperature of the air being supplied to the AOI is detected to be less than the first predefined temperature set by the occupants and the occupants are also detected within the AOI, method 200 may include the steps of operating the heat pump, and the electric heater to adjust the temperature of the air being supplied to the AOI to the first predefined temperature.

In one or more embodiments, when the monitored real-time temperature of the air being supplied to the AOI is detected to be less than the first predefined temperature and the occupants are detected to be absent within the AOI, method 200 may include the steps of reducing or stopping the operation of the electric heater and operating the heat pump to increase the temperature of the air being supplied to the AOI.

In one or more embodiments, when the monitored real-time temperature of the air being supplied to the AOI is detected to be greater than the first predefined temperature, method 200 may include the steps of reducing or stopping the operation of the electric heater while operating the heat pump and allowing the supply of air into the AOI to increase or maintain a second predefined temperature within the AOI. In one or more embodiments, when the monitored real-time temperature within the AOI 102 is detected to be greater than a second predefined temperature set by the occupants, method 200 may include the step of stopping the operation of the heat pump as well as the electric heater.

In one or more embodiments, method 200 may include the steps of adjusting the speed of the fan based on a temperature of the air to be supplied to the AOI, thereby increasing or decreasing the temperature of the air supplied to the AOI.

In one or more embodiments, method 200 may include the steps of adjusting heating capacity of the heat pump based on the real-time temperature within the AOI and the first predefined temperature to be maintained within the AOI. Further, heating capacity of the electric heater and/or the fan speed may be adjusted to adjust the temperature of the air supplied to the AOI.

Also described herein is a system for controlling the operation of an HVAC device and an electric heater associated with an area of interest (AOI). In one or more embodiments, (not shown) the system may include an HVAC device or a chiller unit or an air conditioning unit that may be in fluidic communication with an area of interest (AOI) (also referred to as environment, herein). The AOI may be a space or room associated with a building. The AOI may also be a storage space associated with a container or a cargo truck, but is not limited to the like. The system may further include an electric heater in fluidic communication with the HVAC device such that air flowing into the AOI may flow through the HVAC device as well as the electric heater and then into the AOI. The system may include the duct system as explained in the FIGS. 1A and 1B, however, the duct system herein may enable the flow of supply air (ambient air and/or return air) through the HVAC device and the electric heater and then into the AOI In one or more embodiments, the electric heater may be configured upstream or downstream of the HVAC device. This configuration may enable the HVAC device to cool the supply air and further enable the electric heater to heat or warm the supply air being cooled by the HVAC device in order to supply conditioned air within the AOI as per the occupant's comfort. In some embodiments, the electric heater may be in thermal contact with the refrigerant coils associated with the HVAC device to adjust the temperature of the air being supplied through the refrigerant coils of the HVAC device, thereby controlling the cooling capacity of the HVAC device.

In one or more embodiments, the system may further include a variable speed fan configured with the duct system to enable circulation of the air between the ambient and the AOI and further enable the flow of the air through the HVAC device and the electric heater before being supplied to the AOI.

The system may include an occupancy sensor positioned in the AOI. The occupancy sensor may detect the presence or absence of one or more occupants within the AOI. The system may further include a first temperature sensor that may be positioned downstream of the HVAC device to monitor the temperature of the air leaving the HVAC device. Further, the system may further include a second temperature sensor that may be positioned downstream of the electric heater within the duct system or at an outlet of the duct system, or within the AOI in the proximity of the electric heater to monitor the temperature of the air flowing within the AOI after being heated by the HVAC device and/or the electric heater.

The system may further include a thermostat positioned within the AOI. The thermostat may be configured to enable the occupants to set one or more of a first predefined temperature of the air to be supplied into the AOI based on the occupant's comfort, and further set a second predefined temperature to be maintained within the AOI. The first predefined temperature of the air may facilitate adjusting or controlling or maintaining the second predefined temperature within the AOI, however, the first predefined temperature of the air may provide initial comfort to the occupants and the second predefined temperature may further increase the comfort to the occupants.

The system may further include a controller in communication with the HVAC device, the electric heater, the fan/AHU, the occupancy sensor, the thermostat, the first temperature sensor, and the second temperature sensor. In one or more embodiments, the controller may be configured to receive data pertaining to a first predefined temperature for the air to be supplied to the AOI. The controller may further monitor real-time temperature of the air being supplied to the AOI and also detect, using the occupancy sensor, presence of the one or more occupants within the AOI. Accordingly, upon detecting the presence of the one or more occupants within the AOI, the controller may operate the HVAC device and/or the electric heater to adjust the temperature of the air being supplied to the AOI to the first predefined temperature. Further, the controller may stop the operation of the electric heater upon detecting the absence of the occupants within the AOI.

In one or more embodiments, when the monitored real-time temperature of the air being supplied to the AOI is detected to be less than the first predefined temperature and the occupants are detected within the AOI, the controller may be configured to operate the HVAC device in a heating mode and/or further operate the electric heater at a predefined heating capacity to increase the temperature of the air being supplied to the AOI to the first predefined temperature.

In one or more embodiments, when the monitored real-time temperature of the air being supplied to the AOI is detected to be greater than the first predefined temperature and the occupants are detected within the AOI, the controller may be configured to stop or reduce the operation of the electric heater and further operate the HVAC device in a cooling mode to decrease the temperature of the air being supplied to the AOI to the first predefined temperature.

Thus, the invention provides a simple, automated, efficient, and cost-effective system and method for controlling the operation of the heat pump (or HVAC device) being configured with the electric heater to control the temperature of air supplied to the AOI.

Figure 4:
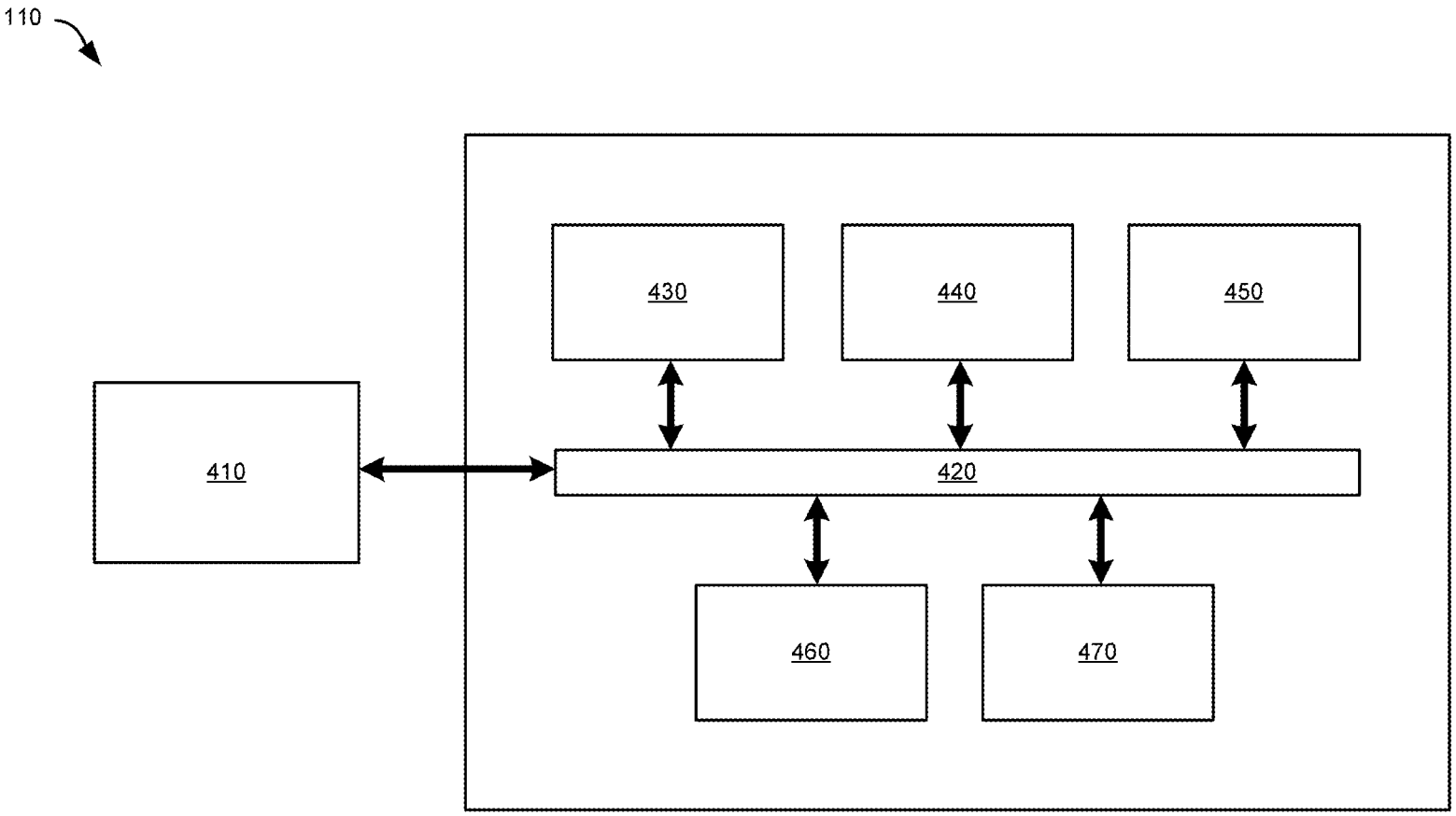
FIG. 4 illustrates an exemplary schematic block diagram of a hardware system used for implementing the controller of FIG. 1, in accordance with one or more embodiments of the subject disclosure.

FIG. 4 is an exemplary schematic block diagram of a hardware system used for implementing the processing device. As shown in FIG. 4, the processing device can include an external storage device 410, a bus 420, a main memory 430, a read only memory 440, a mass storage device 450, communication port 460, and a processor 470. A person skilled in the art will appreciate that the processing device may include more than one processor and communication ports. Examples of processor 470 include, but are not limited to, an Intel® Itanium® or Itanium 2 processor(s), or AMD® Opteron® or Athlon MP® processor(s), Motorola® lines of processors, FortiSOC™ system on chip processors or other future processors. Processor 470 may include various modules. Communication port 460 can be any of an RS-232 port for use with a modem-based dialup connection, a 10/100 Ethernet port, a Gigabit or 10 Gigabit port using copper or fibre, a serial port, a parallel port, or other existing or future ports. Communication port 460 may be chosen depending on a network, such a Local Area Network (LAN), Wide Area Network (WAN), or any network to which processing device connects. Memory 430 can be Random Access Memory (RAM), or any other dynamic storage device commonly known in the art. Read-only memory 440 can be any static storage device(s) e.g., but not limited to, a Programmable Read Only Memory (PROM) chips for storing static information e.g., start-up or BIOS instructions for processor 470. Mass storage 450 may be any current or future mass storage solution, which can be used to store information and/or instructions. Exemplary mass storage solutions include, but are not limited to, Parallel Advanced Technology Attachment (PATA) or Serial Advanced Technology Attachment (SATA) hard disk drives or solid-state drives (internal or external, e.g., having Universal Serial Bus (USB) and/or Firewire interfaces), e.g. those available from Seagate (e.g., the Seagate Barracuda 7102 family) or Hitachi (e.g., the Hitachi Deskstar 7K1000), one or more optical discs, Redundant Array of Independent Disks (RAID) storage, e.g. an array of disks (e.g., SATA arrays), available from various vendors including Dot Hill Systems Corp., LaCie, Nexsan Technologies, Inc. and Enhance Technology, Inc.

Bus 420 communicatively couples processor(s) 470 with the other memory, storage, and communication blocks. Bus 420 can be, e.g., a Peripheral Component Interconnect (PCI)/PCI Extended (PCI-X) bus, Small Computer System Interface (SCSI), USB or the like, for connecting expansion cards, drives and other subsystems as well as other buses, such a front side bus (FSB), which connects processor 470 to software system.

Optionally, operator and administrative interfaces, e.g., a display, keyboard, and a cursor control device, may also be coupled to bus 420 to support direct operator interaction with processing device. Other operator and administrative interfaces can be provided through network connections connected through communication port 460. The external storage device 410 can be any kind of external hard-drives, floppy drives, IOMEGA® Zip Drives, Compact Disc-Read Only Memory (CD-ROM), Compact Disc-Re-Writable (CD-RW), Digital Video Disk-Read Only Memory (DVD-ROM). Components described above are meant only to exemplify various possibilities. In no way should the aforementioned exemplary processing device limit the scope of the subject disclosure.

While the subject disclosure has been described with reference to exemplary embodiments, it will be understood by those skilled in the art that various changes may be made and equivalents may be substituted for elements thereof without departing from the scope of the subject disclosure as defined by the appended claims. Modifications may be made to adopt a particular situation or material to the teachings of the subject disclosure without departing from the scope thereof. Therefore, it is intended that the subject disclosure not be limited to the particular embodiment disclosed, but that the subject disclosure includes all embodiments falling within the scope of the subject disclosure as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A system for controlling operation of a heat pump configured with an electric heater, the system comprising;

an occupancy sensor positioned in an area of interest (AOI) and operable to detect presence or absence of one or more occupants within the AOI, wherein the system is configured to supply air to the AOI while enabling flow of the air through the heat pump and the electric heater; and a controller in communication with the occupancy sensor, the heat pump, and the electric heater, wherein the controller comprises one or more processors coupled to a memory storing instructions executable by the one or more processors, and configured to:

receive data pertaining to a first predefined temperature for the air to be supplied to the AOI;

monitor real-time temperature of the air being supplied to the AOI;

detect, using the occupancy sensor, presence of the one or more occupants within the AOI; and operate, upon detecting the presence of the one or more occupants within the AOI, the heat pump and/or the electric heater to adjust the temperature of the air being supplied to the AOI to the first predefined temperature, wherein responsive to the monitored real-time temperature of the air being supplied to the AOI being less than the first predefined temperature and upon detecting the absence of the one or more occupants within the AOI, the controller is configured to stop operation of the electric heater and operate the heat pump.

2. The system of claim 1, wherein the controller is configured to stop or reduce the operation of the electric heater to adjust the temperature of the air being supplied to the AOI to the first predefined temperature upon detecting the absence of the one or more occupants within the AOI or upon operating the electric heater and the heat pump in a setback mode by the one or more occupants.

3. The system of claim 1, wherein when the monitored real-time temperature of the air being supplied to the AOI is detected to be less than the first predefined temperature and upon detecting the presence of the one or more occupants within the AOI, the controller is configured to operate both of the heat pump, and the electric heater to adjust the temperature of the air being supplied to the AOI to the first predefined temperature.

4. The system of claim 1, wherein when the monitored real-time temperature of the air being supplied to the AOI is detected to be greater than the first predefined temperature, the controller is configured to reduce or stop the operation of the electric heater while allowing the supply of air into the AOI.

5. The system of claim 1, wherein the system comprises a variable speed fan configured with the electric heater or the heat pump, wherein the fan is in communication with the controller and is configured to adjust the speed of the fan, based on a temperature of the air being supplied to the AOI.

6. The system of claim 1, wherein the system comprises a thermostat positioned within the AOI, wherein the thermostat is configured to enable the one or more occupants to set one or more of the first predefined temperature of the air to be supplied into the AOI, and a second temperature to be maintained within the AOI.

7. The system of claim 1, wherein the controller is configured to adjust heating capacity of the heat pump and/or the electric heater based on the real-time temperature of the air being supplied to the AOI and the first predefined temperature for the air to be supplied to the AOI.

8. The system of claim 1, wherein the electric heater is configured downstream of the heating coil of the heat pump.

9. The system of claim 1, wherein when the monitored real-time temperature within the AOI is detected to be greater than a second predefined temperature, the controller is configured to stop the operation of the heat pump and the electric heater.

10. The system of claim 1, wherein the system comprises a temperature sensor positioned in the AOI or at an air outlet of a duct system within which the heat pump and the electric heater are installed, wherein the temperature sensor is configured to monitor the real-time temperature of the air being supplied to the AOI, through the duct system.

11. A system for controlling operation of an HVAC device configured with an electric heater, the system comprising;

an occupancy sensor positioned in an area of interest (AOI) and operable to detect presence or absence of one or more occupants within the AOI, wherein the system is configured to supply air to the AOI while flowing the air through the HVAC device and the electric heater; and a controller in communication with the occupancy sensor, the HVAC unit, and the electric heater, wherein the controller comprises one or more processors coupled to a memory storing instructions executable by the one or more processors, and configured to:

receive data pertaining to a first predefined temperature for the air to be supplied to the AOI;

monitor real-time temperature of the air being supplied to the AOI;

detect, using the occupancy sensor, presence of the one or more occupants within the AOI;

operate, upon detecting the presence of the one or more occupants within the AOI, the HVAC device and/or the electric heater to adjust the temperature of the air being supplied to the AOI to the first predefined temperature; and stop the operation of the electric heater upon detecting the absence of the one or more occupants within the AOI, wherein responsive to the monitored real-time temperature of the air being supplied to the AOI being less than the first predefined temperature and upon detecting the absence of the one or more occupants within the AOI, the controller is configured to stop operation of the electric heater and operate the heat pump.

12. The system of claim 11, wherein when the monitored real-time temperature of the air being supplied to the AOI is detected to be less than the first predefined temperature and upon detecting the presence of the one or more occupants within the AOI, the controller is configured to operate the HVAC device in a heating mode and/or further operate the electric heater at a first predefined heating capacity to increase the temperature of the air being supplied to the AOI to the first predefined temperature.

13. The system of claim 11, wherein when the monitored real-time temperature of the air being supplied to the AOI is detected to be greater than the first predefined temperature and upon detecting the presence of the one or more occupants within the AOI, the controller is configured to stop or reduce the operation of the electric heater and further operate the HVAC device in a cooling mode to decrease the temperature of the air being supplied to the AOI to the first predefined temperature.

14. A method for controlling operation of a heat pump configured with an electric heater, the method comprising the steps of;

detecting, by an occupancy sensor, presence or absence of one or more occupants within an area of interest (AOI);

receiving, by a controller, data pertaining to a first predefined temperature for air to be supplied to the AOI while flowing the air through the heat pump and the electric heater;

monitoring, by the controller, real-time temperature of the air being supplied to the AOI;

operating, by the controller, upon detecting the presence of the one or more occupants within the AOI, the heat pump and/or the electric heater to adjust the temperature of the air being supplied to the AOI to the first predefined temperature; and stopping, by the controller, the operation of the electric heater upon detecting the absence of the one or more occupants within the AOI, wherein responsive to the monitored real-time temperature of the air being supplied to the AOI being less than the first predefined temperature and upon detecting the absence of the one or more occupants within the AOI, stopping operation of the electric heater and operating the heat pump.

15. The method of claim 14, wherein when the monitored real-time temperature of the air being supplied to the AOI is detected to be less than the first predefined temperature and upon detecting the presence of the one or more occupants within the AOI, the method comprises the steps of operating the heat pump, and the electric heater to adjust the temperature of the air being supplied to the AOI to the first predefined temperature.

16. The method of claim 14, wherein when the monitored real-time temperature of the air being supplied to the AOI is detected to be greater than the first predefined temperature, the method comprises the steps of stopping or reducing the operation of the heat pump and/or the electric heater.

17. The method of claim 14, wherein the method comprises the steps of adjusting, based on a temperature to be maintained within the AOI, speed of a fan configured upstream or downstream of the heat pump or the electric heater to control flow rate of the air being supplied to the AOI.

18. The method of claim 14, wherein the method comprises the steps of adjusting heating capacity of the heat pump and/or the electric heater based on the real-time temperature of the air being supplied to the AOI and the first predefined temperature for the air to be supplied to the AOI.

* * * * *